US006722754B1

(12) United States Patent
Delaney et al.

(10) Patent No.: US 6,722,754 B1
(45) Date of Patent: Apr. 20, 2004

(54) PRINTER CARRIAGE JAM DETECTOR USING SENSED MOTOR CURRENT

(75) Inventors: Robert Delaney, Ithaca, NY (US); James R. Del Signore, Trumansburg, NY (US); Kathleen Maginnity, Interlaken, NY (US); John G. Mitchell, Ovid, NY (US); Thomas Parent, Providence, RI (US)

(73) Assignee: Axiohm Transaction Solutions, Inc., Ithaca, NY (US)

( * ) Notice: Subject to any disclaimer, the term of this patent is extended or adjusted under 35 U.S.C. 154(b) by 10 days.

(21) Appl. No.: 10/336,974

(22) Filed: Jan. 3, 2003

(51) Int. Cl.[7] ..... B41J 2/393

(52) U.S. Cl. ..... 347/19

(58) Field of Search ..... 347/19, 23, 104; 400/279, 320, 322, 323, 903

(56) References Cited

U.S. PATENT DOCUMENTS 5,455,604 A * 10/1995 Adams et al. ..... 347/104

* cited by examiner

*Primary Examiner*—Juanita Stephens
(74) *Attorney, Agent, or Firm*—George R. McGuire; Bond, Schoeneck & King, PLLC

(57) ABSTRACT

There is provided a method for monitoring paper or other jams of a carriage in a printer by monitoring the current waveshape in a first winding of a stepper motor at or near the time when a second winding of the stepper motor commutates. The current waveshape is received from a low-value sensing resistor, typically within an integrated circuit stepper motor driver device. Changes in the current waveshape during this time window may be interpreted and accurate deductions may be made concerning the loading of the stepper motor. In the case where the stepper motor is the drive motor for a printer carriage, the loading information may be used to detect a paper jam or similar problem in the printer carriage.

8 Claims, 7 Drawing Sheets

PRINTER CARRIAGE JAM DETECTOR USING SENSED MOTOR CURRENT

FIELD OF THE INVENTION

This invention relates to jam detection in a printer and, more particularly, to detecting carriage jams by sensing current in a carriage drive stepper motor.

BACKGROUND OF INVENTION

Detecting paper jams in a printer is important for several reasons. First, continued application of driving force to the carriage drive motor after a paper jam may cause physical damage to the print head, its associated mounting structure, or other carriage hardware. Also, paper may be bunched or compacted to the point where its removal is difficult without disassembling the print head or another part of the carriage structure. An improperly detected jam may result in the destruction of a payment document, such as the only personal check a customer may have. In addition, data sent to the printer for printing may be discarded and possibly irretrievably lost if the printer electronics are not notified on a timely basis that the data has not been successfully printed.

Traditionally, paper jams near the print head carriage in a printer have been detected using some combination of interruptive sensors (i.e., see-through sensors) and comb strips. These implementations require additional mechanical hardware as well as extra electrical circuitry. Extra hardware in the carriage area not only adds cost and takes up valuable space within the printer, but it may contribute to paper jams in the carriage area by its very presence. Typical jam detection hardware, monitoring electronics and software are taught in U.S. Pat. No. 5,074,690 for PRINT HEAD CARRIAGE HOMING SYSTEM, issued Dec. 24, 1991 to James R. Del Signore, II, et al.

Many small, low-cost printers such as those used in point-of-sale (POS) checkout stations use stepper motors to drive their carriages. Typically, only a subset of the multiple stepper motor windings are driven simultaneously. This allows current induced in other, undriven windings to be monitored and the instantaneous status of the stepper motor movement deduced. Monitoring electrical current provided to a motor, whether stepper, DC, AC, etc., has long been used as a technique to deduce the motional status of the motor.

U.S. Pat. No. 4,383,209 for CONTROL SYSTEM FOR TRANSDUCER POSITIONING MOTOR, issued May 10, 1983 to Martyn A. Lewis, teaches a control system for a stepper motor in which both voltage and current are sensed in a closed-loop controller. The thrust of the LEWIS circuit, however, is to enhance the positional accuracy of a transducer such as a read head in a disk drive. Both a constant voltage and a constant current source are provided with seamless switching, while coarse seeking the constant current source provided the motor drive. During fine seeking of the track position, the constant voltage source provides the motor drive. LEWIS, however, teaches no monitoring of either current or voltage to determine a stalled condition such as would be experienced during a carriage jam in a printer.

The system of the present invention monitors phase current to derive a logic signal indicating to the printer controller that a carriage jam has occurred.

U.S. Pat. No. 5,032,781 for METHOD AND CIRCUIT FOR OPERATING A STEPPER MOTOR, issued Jul. 16, 1991 to Klaus Kronenberg, teaches another stepper motor controller wherein an induced voltage in a winding, which is not required at the time to produce a propulsive force, is evaluated and a stopped motor condition detected. KRONENBERG stores the instantaneous position of the motor in memory for later recovery.

In contradistinction, the inventive system monitors the current waveform of a driven winding of the carriage stepper motor. An amplifier and a comparator are used to digitize the analog voltage waveform from across a sense resistor in the stepper motor's drive line. An operational amplifier having its gain optimized for the application is used to ensure that digitization of the current waveform corresponds accurately with known values in a digital count table.

U.S. Pat. No. 5,074,690 for PRINT HEAD CARRIAGE HOMING SYSTEM, issued Dec. 24, 1991, to James R. Del Signore II, et al., teaches using a ribbon timing strip and a sensor for printer jam detection. No current sensing in a stepper motor winding is disclosed.

Another stepper motor drive system is disclosed in U.S. Pat. No. 5,367,239 for PRINTER CARRIER DRIVING METHOD, issued Nov. 22, 1994 to Tsuyoshi Matsushita, et al. MATSUSHITA, et al., teaches a stepper motor drive where improved control of acceleration and deceleration is achieved from a single-voltage power source. Stored data corresponding to acceleration, constant speed printing, and deceleration are used to generate a current reference voltage. There is, however, no teaching of jam detection through monitoring of either current or voltage supplied to the stepper motor.

The inventive system, on the other hand, monitors current in a single winding of the stepper motor at the commutation time of another winding to derive highly accurate jam detection (i.e., stalled carriage) information.

U.S. Pat. No. 5,431,502 for CARRIAGE MOTOR CONTROLLER FOR PRINTER, issued Jul. 11, 1995 to Yasunori Orii, et al., teaches yet another stepper motor controller for a printer carriage. ORII, et al. use a rotary encoder to generate position data and generate acceleration/deceleration commands based upon both absolute position data from the encoder as well as from stored motor characteristic data. The stored motor characteristic data is periodically updated to reflect the current operating characteristics of the stepper motor. There is, however, no teaching of carriage jam detection through voltage and/or current monitoring.

The inventive system, on the other hand, develops a jam signal from the A to D conversion of a voltage signal obtained from a low value series resistor in one of the stepper motor winding drive lines. An operational amplifier having a carefully selected gain functions to provide a signal indicative of operational current levels that can be read by commercial A/D converters. The inventive system monitors the current waveshape in the "Phase A" winding at the time when the "Phase B" commutation occurs. By selecting this time window, the accuracy of the detection is greatly enhanced.

U.S. Pat. No. 6,150,789 for STEPPER MOTOR CONTROL, issued Nov. 21, 2000 to Robert Pulford, Jr., teaches sensing current in one winding of a stepper motor for control purposes. PULFORD discloses no sampling of current specifically during the commutation of a different motor phase winding. Neither does PULFORD specifically teach jam detection in a printer carriage.

None of these patents taken individually or in any combination teaches or suggests the carriage jam detection method of the present invention.

It is therefore an object of the invention to provide a carriage jam detection method for use in a printer which requires neither a comb nor flag and sensor mechanism to reliably detect carriage jams.

It is a further object of the invention to provide a carriage jam detection method for use in a printer which monitors current in a single, active winding of a stepper motor driving the printer carriage.

It is an additional object of the invention to provide a carriage jam detection method for use in a printer which monitors current in a first stepper motor winding at approximately, but not limited to, the time that a second winding of the stepper motor commutates.

It is another object of the invention to provide a carriage jam detection method for use in a printer which does not necessarily require an additional, external motion sensor.

It is a further object of the invention to provide a carriage jam detection method for use in a printer which utilizes a small resistor in the motor drive circuit as a sensing resistor to obtain a voltage waveform representative of the instantaneous motor winding current.

SUMMARY OF INVENTION

The present invention is a method for monitoring the current waveshape in a first winding of a stepper motor at or near the time when a second winding of the stepper motor commutates. The current waveshape is received from a low-value sensing resistor, typically within an integrated circuit stepper motor driver device. Changes in the current waveshape during this time window may be interpreted and accurate deductions may be made concerning the loading of the stepper motor. In the case where the stepper motor is the drive motor for a printer carriage, the loading information may be used to detect a paper jam, similar problem, or reference position in the printer carriage. No external monitoring sensor is required, nor is there any need for traditional comb or similar look-through structures for use in combination with a light source and sensor for detecting carriage jams.

BRIEF DESCRIPTION OF THE DRAWINGS

A complete understanding of the present invention may be obtained by reference to the accompanying drawings, when taken in conjunction with the detail description thereof and in which.

DESCRIPTION OF THE PREFERRED EMBODIMENT

The present invention features a novel way of monitoring winding current in a stepper motor used as a carriage drive motor in a printer so as to detect a printer carriage jam. The inventive method utilizes no external mechanical or electrical components. The inventive method relies on detecting a significant (i.e., measurable) change in at least one significant feature of the current waveform in at least one winding of the carriage drive stepper motor.

Figure 1A:
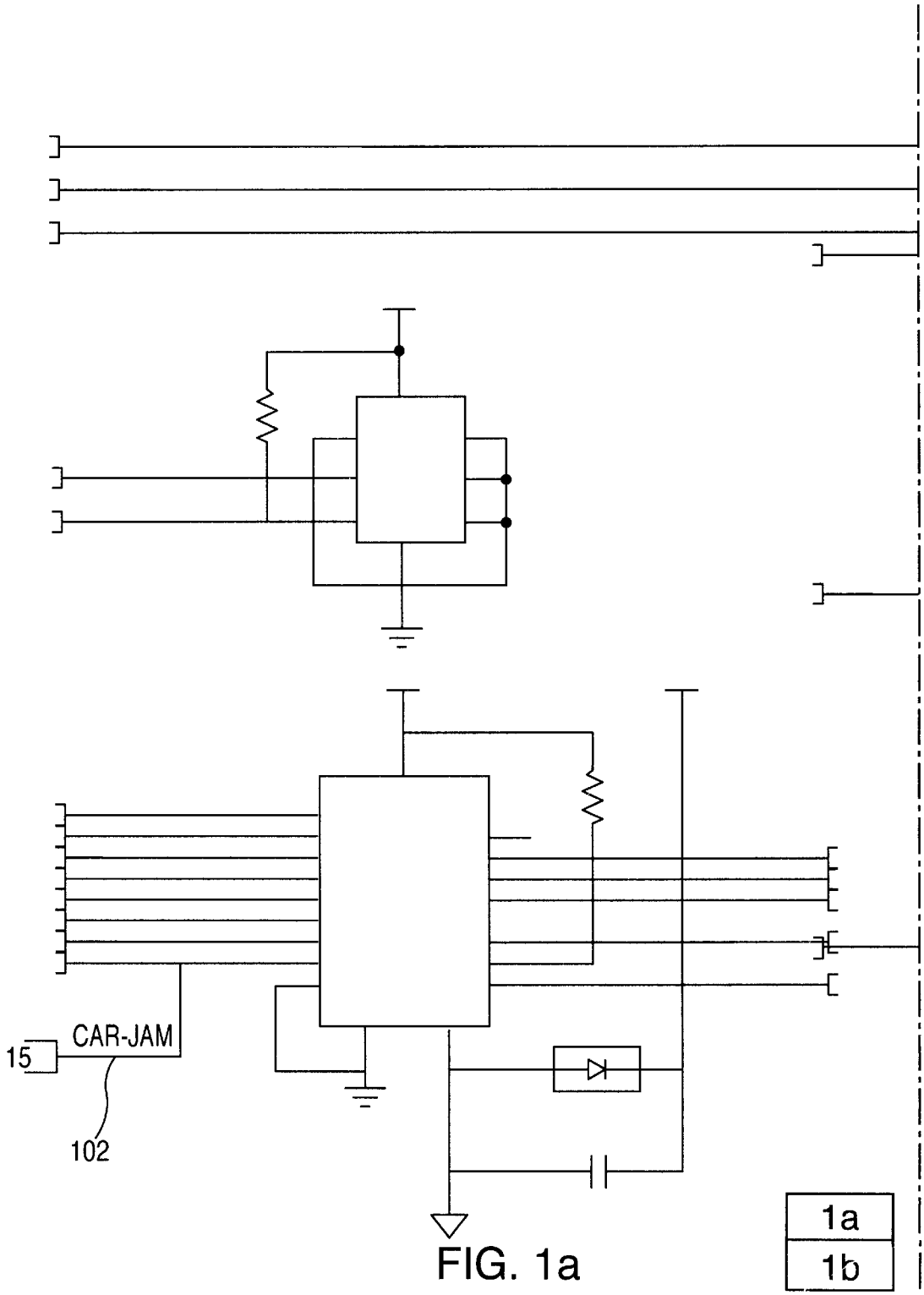
FIGS. 1*a* and 1*b* is a schematic diagram of the A/D converter showing the application of the CAR_JAM signal.
Figure 1B:
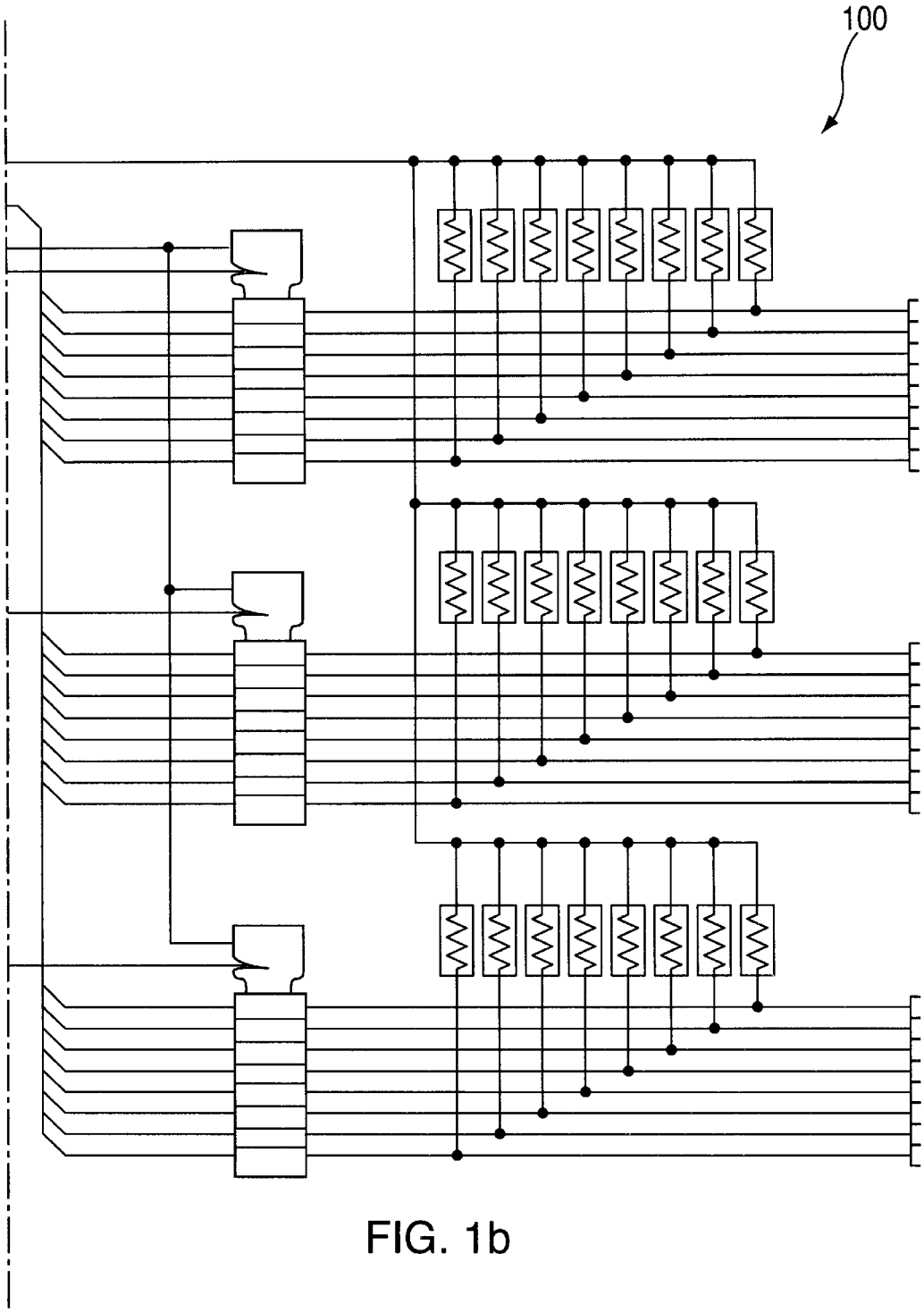

Referring first to FIG. 1, there is shown a schematic diagram 100 of a portion of the control electronics used in a typical small, desktop printer. A new carriage jam (CAR_JAM) signal 102 is developed to replace a jam detect signal previously generated by a typical light source/sensor apparatus of the prior art. The generation of the CAR_JAM signal is described in detail hereinbelow. CAR_JAM signal 102 is applied to channel 7 of an A/D converter, such as National Semiconductor ADC08388 8 channel A/D converter, which converts the selected analog input signal into digital count from 0 to 256 for the controlling microprocessor to read.

Figure 2:
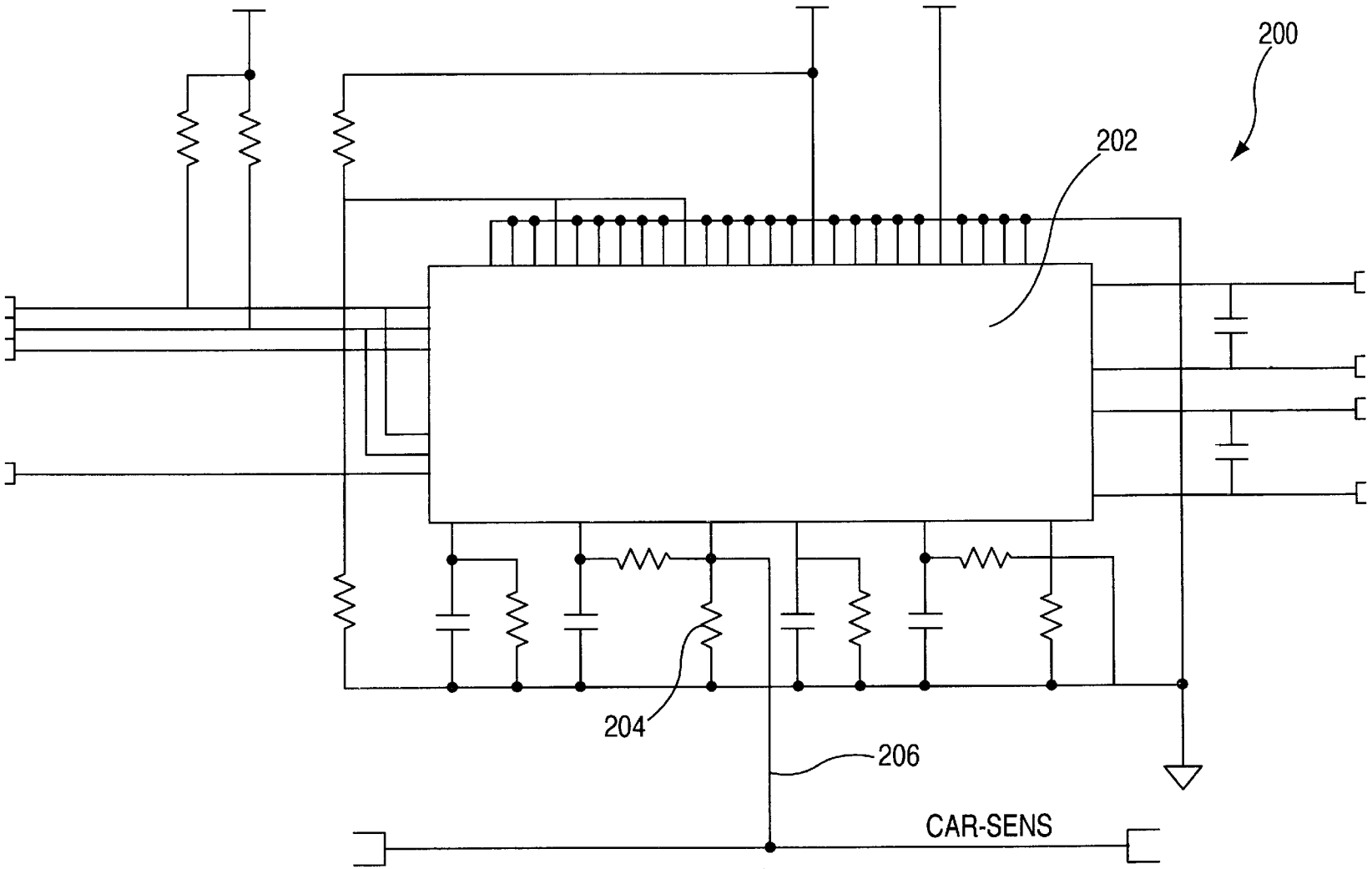
FIG. 2 is a schematic diagram of a portion of the stepper motor controller showing the origin of the CAR_SENSE signal.
Figure 3A:
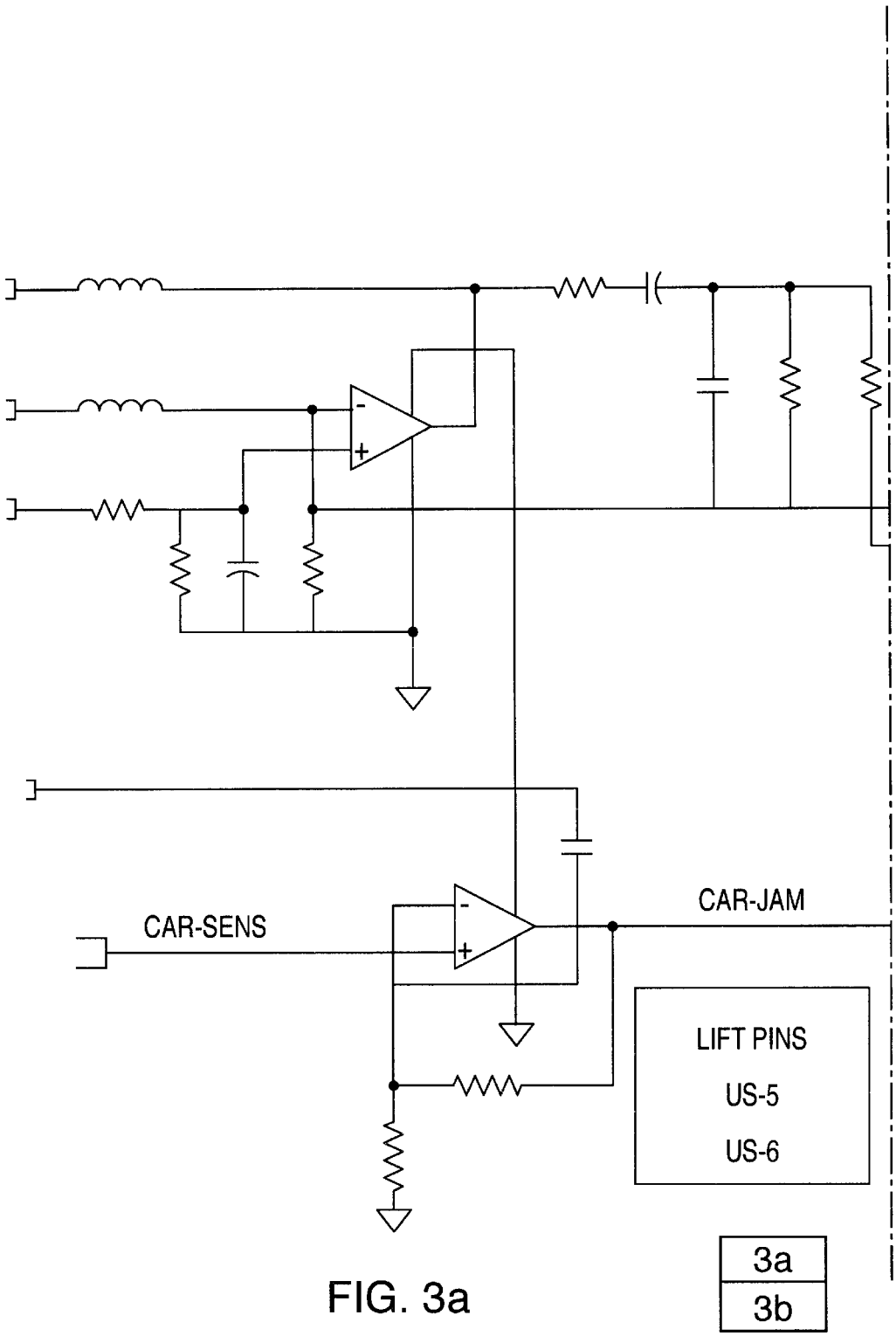
FIGS. 3*a* and 3*b* is a schematic diagram showing the generation of the CAR_JAM signal from the CAR_SENSE signal.
Figure 3B:
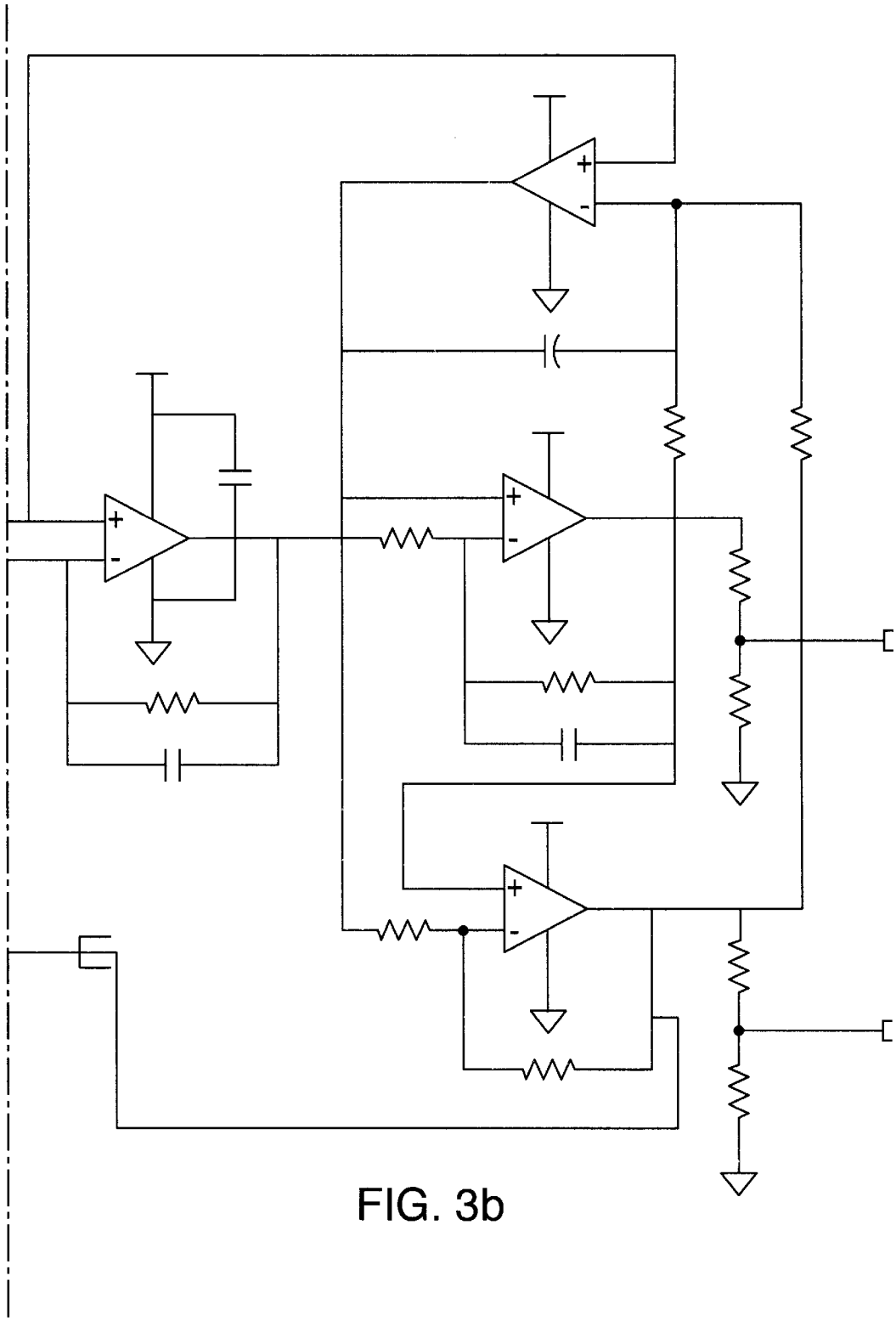

Referring now to FIG. 2, there is shown a schematic diagram 200 of another portion of the printer's control electronics. The stepper motor drive circuit 202 is typically a dual full-bridge PWM driver chip such as one of the Allegro Micro Systems 291x family of chips. It will be recognized by those of skill in the art that a wide variety of similar devices from other manufacturers is available in the marketplace; any of these device could be utilized to perform the functions of the Allegro Type 2916 chip chosen for purposes of disclosure. A low-value internal sense resistor 204 located in series with the Phase 1 current output. The value of internal sense resistor 204 is approximately 0.8 ohms, in the 2916 chip. The voltage across resistor 204 is provided at an output pin of the Allegro 2916 chip as signal "Sense 1". This signal 206 provided on the sense 1 output pin is called CAR_SENS.

A series of equations may be developed to model the behavior of the circuitry for implementing the inventive method. For purposes of disclosure, the sense resistor $R_s$ is chosen to have a resistance of approximately 0.82 ohms with an assumed approximately ±1% tolerance ($DR_s=0.01\times R_s$) An op-amp feedback resister $R_f$ is chosen to be approximately 4750 ohms. An op-amp input resister $R_i$ is chosen to be approximately 1000 ohms. The A/D reference voltage is chosen to be approximately 2.5 volts with a tolerance of approximately ±0.005 volt. The A/D count is chosen to be 256 (i.e., 0–255, $CNT_{max}=255$). The maximum phase current is chosen to be 500 ma.

It will be recognized by those skilled in the circuit design art that other sets of component values and/or parameters could also be chosen to practice the method of the present invention.

Using the parameters specified, the input phase current range may be specified and linearized:

$$t=1 \ldots CNT_{max}+1$$

and:

$$Im_t = \frac{I\max(t-1)}{CNT_{\max}+1} \cdot 10^{-3}$$

An output voltage may be computed:

$$Vo_t = Im_t \cdot Rs \cdot \left(\frac{Rf}{Ri} + 1\right)$$

The A/D count may be calculated and rounded:

$$CNT_t = \left[\frac{Im_t \cdot Rs \cdot \left(\frac{Rf}{Ri} + 1\right)}{Vref}\right] \cdot CNT_{\max}$$

Next, the count error caused by $R_1$ may be determined:

$$A1_t = \frac{d}{dRi}\left[\left[\frac{Im_t \cdot Rs\left(\frac{Rs}{Ri} + 1\right)}{V_{ref}}\right] \cdot CNT_{\max}\right]$$

Likewise, the error count caused by $R_2$ may also be determined:

$$A2_t = \frac{d}{dRs}\left[\left[\frac{Im_t \cdot Rs \cdot \left(\frac{Rf}{Ri} + 1\right)}{V_{ref}}\right] \cdot CNT_{\max}\right]$$

Also, the error count caused by $R_3$ may be determined:

$$A3_t = \frac{d}{dRf}\left[\left[\frac{Im_t \cdot Rs \cdot \left(\frac{Rf}{Ri} + 1\right)}{V_{ref}}\right] \cdot CNT_{\max}\right]$$

The error count caused by $V_{ref}$ may be determined:

$$A4_t = \frac{d}{dV_{ref}}\left[\left[\frac{Im_t \cdot Rs \cdot \left(\frac{Rf}{Ri} + 1\right)}{V_{ref}}\right] \cdot CNT_{\max}\right]$$

The total error count is, therefore:

$$E_t = (DRs \cdot |A1_t|) + (DRf \cdot |A2_t|) + (DRi \cdot |A3_t|) + (DV_{ref} \cdot |A4_t|)$$

Rounding off, the upper and lower limits of the count are:

$$COH_t = CNT_t + E_t$$

and $$COH_t = \text{ceiling}\ (COH_t)$$

$$COL_t = CNT_t - E_t$$

and $$COL_t = \text{floor}(COL_t)$$

Finally, the total error count may be expressed as:

$$ET_t = \left(\frac{COH_t - COL_t}{CNT_t}\right) \times 100$$

Using this information, the digital count and error vs. the A/D input voltage may calculated as shown in TABLE I, below.

TABLE I

| $Im_t \times 10^3$ | $Vo_t$ | $COL_t$ | $CNT_t$ | $COH_t$ | $E_t$ |
|---|---|---|---|---|---|
| 0 | 0 | 0 | 0 | 0 | 0 |
| 1.953 | $9.20910^{-3}$ | 0 | 1 | 2 | 0.014 |
| 3.096 | 0.018 | 1 | 2 | 3 | 0.028 |
| 5.859 | 0.028 | 2 | 3 | 4 | 0.042 |
| 7.813 | 0.037 | 3 | 4 | 5 | 0.056 |
| 9.766 | 0.046 | 4 | 5 | 6 | 0.070 |
| 11.719 | 0.055 | 5 | 6 | 7 | 0.085 |
| 13.672 | 0.064 | 6 | 7 | 8 | 0.099 |
| 15.625 | 0.074 | 7 | 8 | 9 | 0.113 |
| 17.578 | 0.083 | 8 | 9 | 10 | 0.127 |
| 19.531 | 0.092 | 9 | 10 | 11 | 0.141 |
| 21.481 | 0.101 | 10 | 11 | 12 | 0.155 |
| 23.438 | 0.111 | 11 | 12 | 13 | 0.169 |
| 25.391 | 0.120 | 12 | 13 | 14 | 0.183 |
| 27.344 | 0.129 | 13 | 14 | 15 | 0.197 |
| 29.297 | 0.138 | 14 | 15 | 16 | 0.211 |
| 31.250 | 0.147 | 15 | 16 | 17 | 0.255 |
| 33.203 | 0.157 | 15 | 16 | 17 | 0.240 |
| 35.156 | 0.166 | 16 | 17 | 18 | 0.254 |
| 37.109 | 0.175 | 17 | 18 | 19 | 0.268 |
| 39.063 | 0.184 | 18 | 19 | 20 | 0.282 |
| 41.016 | 0.193 | 19 | 20 | 21 | 0.296 |
| 42.969 | 0.203 | 20 | 21 | 22 | 0.310 |
| 44.942 | 0.212 | 21 | 22 | 23 | 0.324 |
| 46.875 | 0.221 | 22 | 23 | 24 | 0.338 |
| 48.828 | 0.230 | 23 | 24 | 25 | 0.352 |

Only a partial table has been presented. It will be recognized that, using the equations presented hereinabove, a complete table may be produced. It has been found that, for motor currents in the range of 0–500 ma (typical of the drive currents used for a stepper motor driving the carriage of a small printer) and with an A/D count range of approximately 0–255, there is less than approximately a 4% error.

Figure 4:
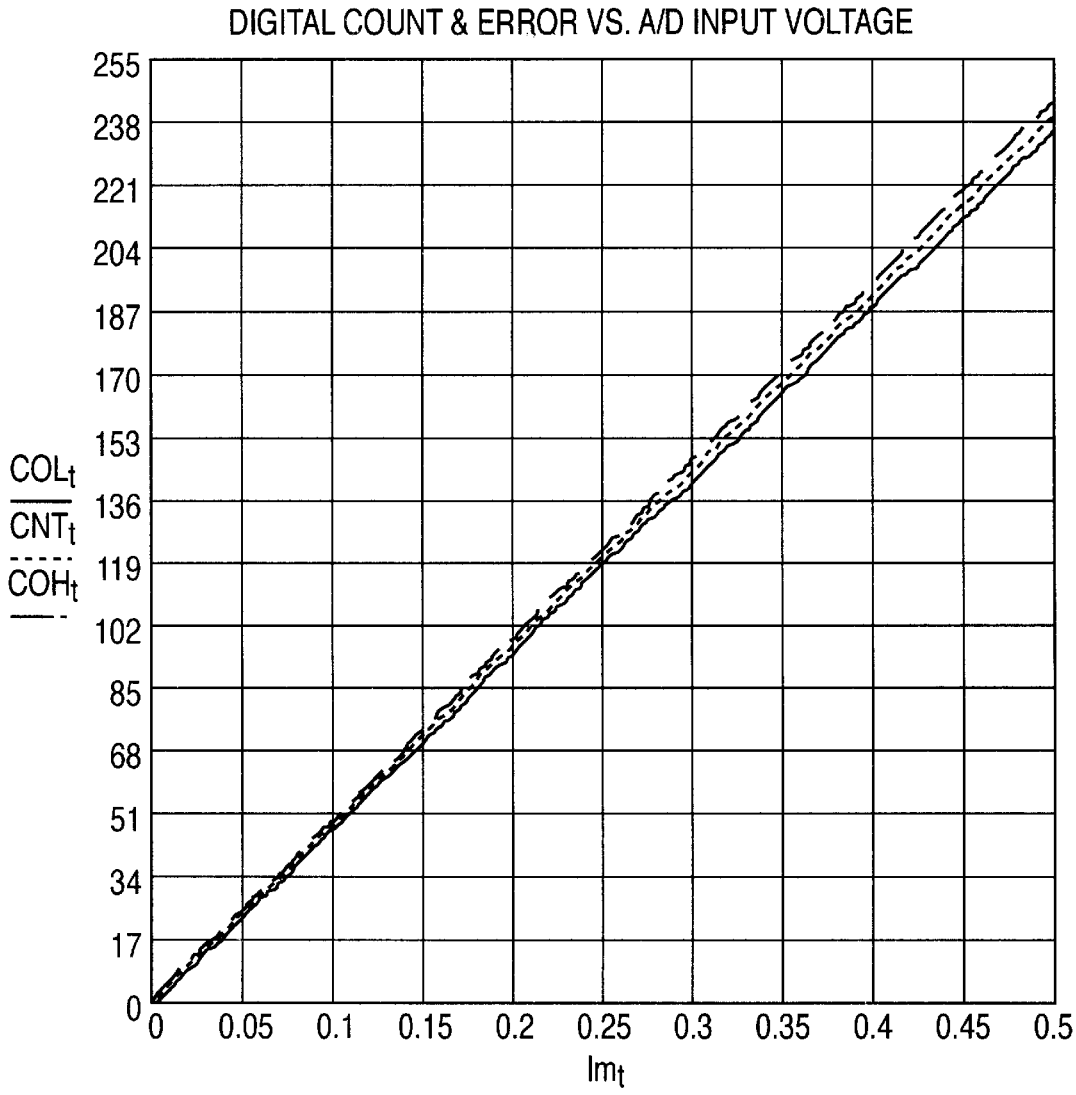
FIG. 4 is a graph showing digital count error vs. the A/D input voltage.

The information from TABLE I is plotted as shown in FIG. 4.

Figure 5A:
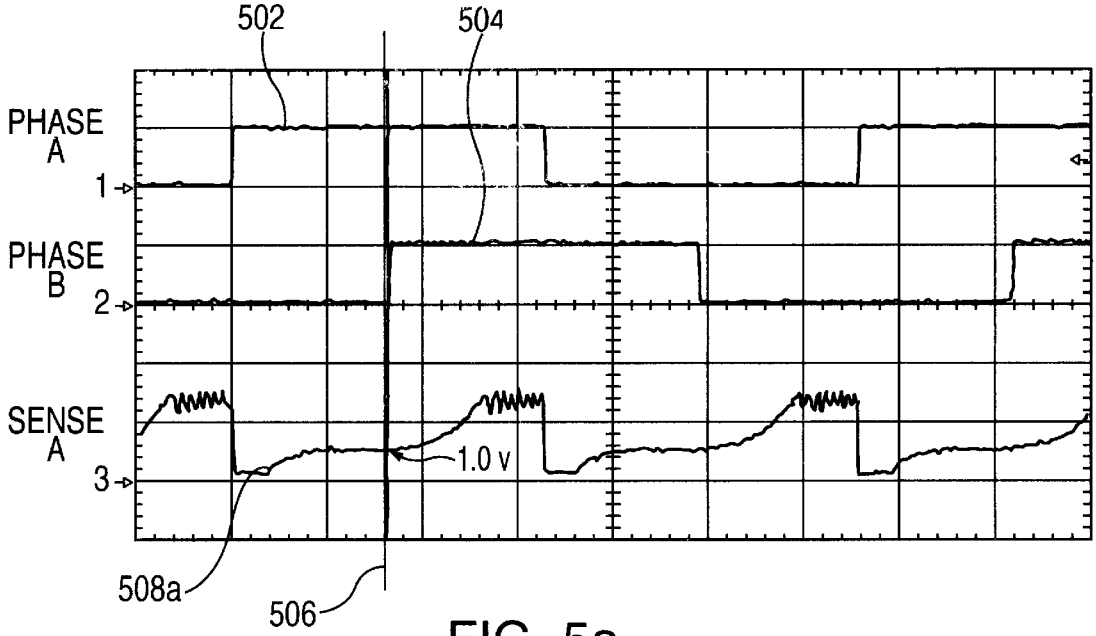
FIG. 5*a* is a graph showing the relationship between motor phase voltage and the current waveform during normal operation.
Figure 5B:
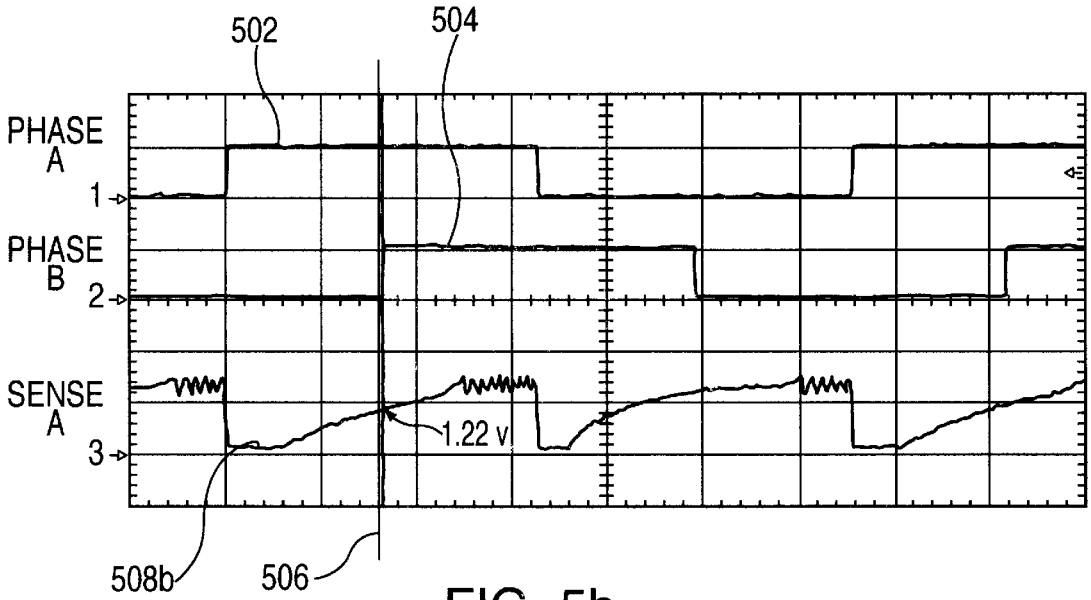
FIG. 5*b* is a graph showing the relationship between motor phase voltage and the current waveform under a carriage jam condition.

Referring now to FIGS. 5*a* and 5*b*, there are shown oscillographic traces of phase A motor current, phase B motor current and the sense voltage for both a normal operating condition and a carriage jammed condition, respectively. A first drive signal 502 (Phase A) is applied to a first independent winding of a stepper motor (not shown). A second drive signal 504 (Phase B) is applied to a second independent winding. Drive signal 504 is applied at a later time than drive signal 502. This timing is typical of how stepper motors are driven. While only two drive signals have been shown for purposes of disclosure, it will be recognized by those of skill in the stepper motor arts that additional drive signals and sequences are commonly used in stepper motor arrangements.

The time at which a drive signal is applied to a stepper motor winding is known as commutation time. For the method of the present invention, the time of commutation of the second drive signal 504 is of particular interest. This time has been identified as reference number 506. The sense voltage developed across the sense resistor in series with the first stepper motor winding is shown at 508*a* and 508*b* in FIGS. 5*a* and 5*b*, respectively. During normal operation (FIG. 5*a*), the sense voltage 508*a* at time 506 is approximately 1.0 volt. However, during a jammed carriage condition (FIG. 5*b*), the sense voltage 508*b* at time 506 is approximately 1.22 volts and greater than the four percent error predicted for normal operations. This significant voltage difference is sufficient to reliably differentiate between normal carriage operation and a jammed carriage condition. When a predetermined sense voltage threshold is reached, a jammed carriage or other appropriate error signal is generated. The values chosen for purposes of disclosure will vary with the use of different stepper motors, stepper motor drivers and chosen component values.

While the instantaneous value of the Phase A current waveform at the commutation of Phase B has been chosen as the waveform feature of interest for making a jammed condition determination, other features of the current waveform could also be used to satisfy a particular operating requirement.

It will be recognized that the method of the present invention may readily be applied to any stepper motor, regardless of the application. The invention, therefore, is not considered limited to the environment of a printer carriage drive system which has been chosen for purposes of disclosure.

Since other modifications and changes varied to fit particular operating requirements and environments will be apparent to those skilled in the art, the invention is not considered limited to the examples chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A method for detecting a carriage jam in a printer having a stepper motor driven carriage, the steps comprising:

a) providing a stepper motor having at least a first and a second independent winding for driving the carriage of a printer;

b) applying a first, predetermined drive signal comprising a first current and corresponding first voltage waveform to said first winding at a first time;

c) applying a second, predetermined drive signal to said second winding at a second, predetermined time, said second, predetermined time being later than said first predetermined time and during a time while said first, predetermined drive signal is still being applied to said first winding;

d) defining a reference waveform from the group: voltage waveform and current waveform, for at least a non-jammed operating condition of said stepper motor at approximately said second time;

e) observing said first voltage waveform at approximately said second time;

f) comparing said first voltage waveform to said reference waveform based upon at least one predetermined feature of said first voltage waveform and said reference waveform; and g) generating a jam detected signal when said at least one predetermined feature of said first voltage waveform differs from said at least one feature of said reference waveform by a predetermined amount.

2. The method for detecting a carriage jam in a printer having a stepper motor driven carriage as recited in claim 1, wherein said first voltage waveform is produced across a resistor placed in series with said first independent winding.

3. The method for detecting a carriage jam in a printer having a stepper motor driven carriage as recited in claim 1, wherein said reference voltage waveform is substantially identical to said first voltage waveform obtained when said stepper is operated to drive said printer carriage and said printer carriage is in a non-jammed condition.

4. The method for detecting a carriage jam in a printer having a stepper motor driven carriage as recited in claim 1, wherein said second time occurs approximately halfway through a duration of said first predetermined drive signal applied to said first independent winding.

5. A method for detecting a stalled stepper motor, the steps comprising:

a) providing a stepper motor having at least a first and a second independent winding and a driven load operatively connected thereto;

b) applying a first, predetermined drive signal comprising a first current and corresponding first voltage waveform to said first winding at a first time;

c) applying a second, predetermined drive signal to said second winding at a second, predetermined time, said second, predetermined time being later than said first predetermined time and during a time while said first, predetermined drive signal is still being applied to said first winding;

d) defining a reference voltage waveform for a non-stalled, normal operating condition of said stepper motor at approximately said second time;

e) observing said first voltage waveform at approximately said second time;

f) comparing said first voltage waveform to said reference voltage waveform; and g) generating a stall detected signal when at least one predetermined feature of said first voltage waveform differs from said at least one feature of said reference waveform by a predetermined amount.

6. The method for detecting a stalled stepper motor, as recited in claim 5, wherein said first voltage waveform is produced across a resistor placed in series with said first independent winding.

7. The method for detecting a stalled stepper motor, as recited in claim 5, wherein said reference voltage waveform is substantially identical to said first voltage waveform obtained when said stepper motor is operated in said normal, unstalled condition.

8. The method for detecting a stalled stepper motor, as recited in claim 5, wherein said second time occurs approximately halfway through a duration of said first predetermined drive signal applied to said first independent winding.

* * * * *